US008998467B2

(12) United States Patent
Dubosc et al.

(10) Patent No.: US 8,998,467 B2
(45) Date of Patent: Apr. 7, 2015

(54) OPTICAL SYSTEM FOR A MOTOR VEHICLE

(75) Inventors: Christophe Dubosc, Villemomble (FR); Etienne Pauty, Paris (FR); Antoine de Lamberterie, Paris (FR)

(73) Assignee: Valeo Vision, Bobigny (FR)

( * ) Notice: Subject to any disclaimer, the term of this patent is extended or adjusted under 35 U.S.C. 154(b) by 207 days.

(21) Appl. No.: 13/575,114

(22) PCT Filed: Feb. 7, 2011

(86) PCT No.: PCT/EP2011/051736

§ 371 (c)(1),
(2), (4) Date: Oct. 17, 2012

(87) PCT Pub. No.: WO2011/101268

PCT Pub. Date: Aug. 25, 2011

(65) Prior Publication Data

US 2013/0027956 A1 Jan. 31, 2013

(30) Foreign Application Priority Data

Feb. 19, 2010 (FR) ..... 10 51229

(51) Int. Cl.

| | |
|---|---|
| ***F21V 8/00*** | (2006.01) |
| ***F21S 8/10*** | (2006.01) |
| *F21Y 105/00* | (2006.01) |

(52) U.S. Cl.

CPC ..... *F21S 48/2225* (2013.01); *F21S 48/215* (2013.01); *F21S 48/217* (2013.01); *F21S 48/115* (2013.01); *F21Y 2105/00* (2013.01); *F21Y 2105/008* (2013.01)

(58) Field of Classification Search

CPC ..... F21V 5/043; F21V 5/046; F21Y 2105/00; F21Y 2105/008; F21S 48/217; F21S 48/2212; F21S 48/1225; F21S 48/1163; F21S 48/115; F21S 48/215; F21S 48/2225

See application file for complete search history.

(56) References Cited

U.S. PATENT DOCUMENTS

| | | | | |
|---|---|---|---|---|
| 7,019,334 | B2 | 3/2006 | Yatsuda et al. | |
| 7,312,477 | B2 | 12/2007 | Yatsuda et al. | |
| 7,622,748 | B2 | 11/2009 | Yatsuda et al. | |
| 7,645,054 | B2 | 1/2010 | Goihl | |
| 7,922,358 | B2 | 4/2011 | von Malm | |
| 7,985,011 | B2 | 7/2011 | Ajiki et al. | |
| 8,093,613 | B2 | 1/2012 | Yatsuda et al. | |
| 8,764,259 | B2 * | 7/2014 | Schug | 362/538 |

(Continued)

FOREIGN PATENT DOCUMENTS

| | | |
|---|---|---|
| DE | 20207799 | 8/2002 |
| EP | 0756132 | 1/1997 |

(Continued)

*Primary Examiner* — Bao Q Truong

(74) *Attorney, Agent, or Firm* — Jacox, Meckstroth & Jenkins

(57) ABSTRACT

An optical system for a motor vehicle, in particular for an indicating and/or lighting device, arranged to emit a light, the intensity of which is maximal in a given prioritized optical direction. The optical system comprises a surface light source exhibiting a front wall emitting a light, the intensity of which is maximal in a principal direction of emission, and an optical guide comprising an input face and an output face forming at least partly an outer face of the system, the system being arranged such that the light penetrates the guide through the input face and escapes through the output face. The optical guide being conformed such that the intensity of the light at the output of the system is maximal in a prioritized optical direction.

21 Claims, 4 Drawing Sheets

(56) References Cited

U.S. PATENT DOCUMENTS

| | | | | |
|---|---|---|---|---|
| 2004/0090790 | A1* | 5/2004 | Ishida et al. | 362/507 |
| 2004/0251469 | A1 | 12/2004 | Yatsuda et al. | |
| 2006/0071222 | A1 | 4/2006 | Yatsuda et al. | |
| 2008/0068852 | A1* | 3/2008 | Goihl | 362/509 |
| 2008/0117646 | A1 | 5/2008 | Yatsuda et al. | |
| 2009/0097234 | A1 | 4/2009 | von Malm | |
| 2009/0129080 | A1* | 5/2009 | Wanninger et al. | 362/235 |
| 2009/0262547 | A1 | 10/2009 | Ajiki et al. | |
| 2010/0073951 | A1 | 3/2010 | Yatsuda et al. | |
| 2011/0079772 | A1 | 4/2011 | Ben Khalifa et al. | |

FOREIGN PATENT DOCUMENTS

| | | |
|---|---|---|
| EP | 1487025 | 12/2004 |
| EP | 2105655 | 9/2009 |
| FR | 2926677 | 7/2009 |
| GB | 2405755 | 3/2005 |

* cited by examiner

OPTICAL SYSTEM FOR A MOTOR VEHICLE

CROSS-REFERENCE TO RELATED APPLICATIONS

This application claims priority to PCT Application PCT/EP2011/051736 filed Feb. 7, 2011, and also to French Application No. 1051229 filed Feb. 19, 2010, which applications are incorporated herein by reference and made a part hereof.

BACKGROUND OF THE INVENTION

1. Field of the Invention

The present invention relates to an optical system, in particular for a motor vehicle, such as a lighting and/or indicating device having in particular a photometric function that is useful when the vehicle is moving on the road, allowing the vehicle to be seen by other vehicles or allowing the driver of the vehicle to see outside.

2. Description of the Related Art

Conventional visual indicating or lighting systems for motor vehicles comprise a casing containing a point source of light such as a bulb and an optical system to focus the beam in a principal direction. The outer face of the casing can exhibit varied forms and can for example harmoniously extend the curves of the body, thereby contributing to the aesthetics of the vehicle.

These conventional systems emit light from a point source. Hence, optical devices have been developed to expand the surface area perceived as being the emission zone. However, these optical devices do not enable a homogeneous output of emission, regardless of the direction of observation, to be produced.

Now, for reasons of visibility of the vehicle and therefore safety, as well as for esthetic reasons, it is desirable to emit the light from a surface source and to provide a homogeneous visual output of this source regardless of the direction of observation.

Moreover, surface light sources, such as organic light-emitting diodes (OLEDs), are known. However, conventional OLEDs exhibit a luminance that is too low to be able to be used in an indicating or road lighting application. Typically, the luminance provided by conventional OLEDs is in the order of 1,000 Cd/m$^2$, while 5,000 to 10,000 Cd/m$^2$ would be needed to meet the photometric regulations regarding road indicating.

To address this drawback, modified OLEDs have been produced to markedly increase the directivity of emission of the OLED. The diagram of emission is hence non-Lambertian and the luminous flux is sent in a prioritized optical direction, thereby improving the luminance in this direction. For example, document FR 2 926 677, which is equivalent to U.S. Patent Publication 2011/0079772, which documents are incorporated herein by reference and made a part hereof, discloses an organic light-emitting diode device emitting a light beam exhibiting high directivity. Such an organic light-emitting diode comprises, between these two electrodes, various layers, in particular a light-emitting layer, a layer encouraging the transport of electrons up to the emitting layer and a layer encouraging the transport of holes up to the emitting layer. All these layers form a microcavity, the thickness of which is adjusted to create an optical resonance. The result of such a structure is an emission of a light beam exhibiting high directivity.

These modified OLEDs exhibit several particularly disadvantageous drawbacks. These organic light-emitting diodes today comprise small molecules, since they are the most efficient and more suited to producing an indicating function in a limited space, for example a vehicle rear wing. However, these molecules must be protected from water and oxygen molecules, and this is achieved using glass sheets. OLEDs used for performing an indicating function therefore comprise a protective glass sheet in contact with the emitting layer. The glass sheets highly restrict the possible forms of the organic light-emitting diodes. The OLEDs must therefore have flat surfaces or at most ruled surfaces, and they therefore cannot consist of a screen having any arbitrary kind of warped surface such as the present-day lens of a lighting and/or indicating device for a motor vehicle. This therefore raises design issues. Furthermore, the prioritized direction of emission of the beam is necessarily normal to the plane of the OLED. These limitations lead to tight constraints both on the form of the system including the OLED and on the orientation of the plate which must be normal to the prioritized optical direction. In practice, the field of application of these modified OLEDs is therefore a priori restricted.

To avoid these constraints of orientation and flatness of the plate, solutions have been developed to create an OLED on a flexible substrate. These OLEDs therefore provide a good freedom of choice concerning the form given to them. They can in particular exhibit a rounded or bent outer surface. They can consequently equip a vehicle to provide a good continuity of form between the body and the display system. However, the luminance of these flexible OLEDs remains relatively low and they are difficult to use, or even unusable, for passenger compartment lighting functions, and even less so for photometric functions such as indicating functions or lighting functions.

Therefore, a need exists to provide a system for emitting light from a surface zone with an improved luminance and a homogeneous output regardless of the direction of observation, while limiting the form constraints imposed on the system.

SUMMARY OF THE INVENTION

The present invention proposes to solve at least one of the problems of the abovementioned prior art.

To this end, there is provided according to the invention an optical system for a motor vehicle, in particular for an indicating and/or lighting device, arranged to emit a light, the intensity of which is maximal in a given prioritized optical direction. The system exhibits an outer face which is not contained in a plane that is substantially normal to the prioritized optical direction. This optical system includes:

a surface light source exhibiting a front wall emitting a light, the intensity of which is maximal in a principal direction of emission, an optical guide comprising an input face and an output face forming at least partly the outer face of the system, the system being arranged such that the light emitted by the surface source penetrates the guide through the input face and escapes from the guide through the output face, the optical guide being conformed such that the intensity of the light at the output of the system is maximal in a direction that is substantially identical to the prioritized optical direction.

Thus, the output face, perceived by an observer as being the emitting surface, can be freely inclined and oriented with respect to the prioritized optical direction. The principal direction can also be different from the prioritized direction. The invention hence offers a wide freedom of choice concerning the form of vehicle outer faces. In particular, guide output faces can be provided that are inclined and/or curved to follow the curvature of the vehicle body.

Furthermore, the invention exhibits the advantage of providing a very homogeneous distribution of the light over the entire output face, i.e. the whole surface of the output face provides the same luminance in a direction in question. Thus, an observer does not identify discontinuities on the output face, and this being regardless of his/her direction of observation. This advantage improves the visibility of the vehicle and enhances its aesthetics.

Generally, the optical system according to the invention provides for preserving the same homogeneity characteristics as those of the surface source. Thus, if the surface source is very homogeneous, as is the case for OLEDs, the output face will also be very homogeneous.

The system according to the invention may also exhibit, optionally, at least any one of the following characteristics:

The surface light source comprises at least one organic light-emitting diode (OLED). The system can comprise a plurality of OLEDs placed side by side to form a surface zone of emission. This also provides for following more precisely the curvature of a cover lens of a lighting and/or indicating device, such as a headlamp, also referred to as a headlight, or an indicating lamp.

The front wall of the surface light source is substantially flat. The principal direction of emission is substantially normal to the front wall of the surface source. This means that certain highly directional OLED technologies can be used, in which the OLEDs are covered with a glass sheet.

The input face of the optical guide covers at least partly the front wall of the surface source. Preferably, the input face is placed directly on the front wall, i.e. in contact.

The input face is oriented with respect to the output face in order that the light penetrating the input face reaches, mainly directly, the output face. The orientation and flatness requirements are therefore transferred to the input face, leaving a great deal of freedom in the orientation and form of the front face.

According to one alternative embodiment, the system includes at least one reflecting face. This system is arranged in order that the reflecting surface reflects onto the output face the light coming from the input face. Preferably, the system is arranged in order that the light penetrating the input face is mainly reflected on the reflecting face so as to reach the output face with an incidence allowing the intensity of the light at the output of the system to be maximal in a direction that is substantially identical to the prioritized optical direction. The orientation and flatness requirements are therefore transferred to the reflecting face.

The area of emission of the surface light source is greater than 1 $cm^2$. To improve the visibility of the function, this surface area can be greater than 10 $cm^2$.

The light source exhibits a high directivity of emission in the direction perpendicular to its emitting surface, as compared with Lambertian light-emitting diodes.

In the direction perpendicular to its emitting surface, the light source has a luminance of at least 5,000 $Cd/m^2$, preferably at least 10,000 $Cd/m^2$. There exist today OLEDs that include means conferring to them this directivity and this luminance. For example, it is possible to use OLEDs such as those described in patent FR2926677, which is equivalent to U.S. Patent Publication 2011/0079772, which documents are incorporated herein by reference and made a part hereof.

The high directivity of the surface light source is characterized in that the light intensity law for this source as a function of the emission angle, θ, is a law of the type: cos(θ)^n;

where n is a power varying between 10 and 20.

The expression "of the type: cos(θ)^n" is understood to mean a function of the angle of emission, θ, changing in the same way as the function cos(θ)^n.

θ=0 corresponds to the principal direction which is perpendicular to the OLED surface.

A portion of the outer face includes an optical mask partly covering the optical guide such that the portion of the unmasked outer face defines the output face. The invention thus provides for reducing the surface perceived as being light-emitting. Furthermore, it provides for concentrating onto a restricted zone the light emitted by the system, thereby improving the luminance of this zone.

The output face is curved or rounded. Alternatively or additionally, the normal to the output face is inclined with respect to the prioritized optical direction. Alternatively or additionally, the output face forms a shape, preferably a ring or the periphery of an ellipse or of a polygon. The shape can be closed or open.

The system includes diffusing reliefs located on the output face and arranged to reveal patterns, preferably lines or points. Alternatively or additionally, it includes diffusing reliefs located inside the optical guide and conformed to form volumic patterns.

The outer face of the guide is covered at least partly by a protective layer, borne for example by a casing within which the system is housed.

Preferably, the system provides for implementing an indicating function such as: a vehicle position indicating function, a direction change indicating function, a reversing indicating function, a braking indication, and a position indicating function in the event of fog. This system can thus form a stop lamp or a center high mount stop lamp or a turn indicator or a reversing lamp.

The system can be used to provide a road lighting function, such as a high beam function, a dipped beam function and a fog lamp function.

The system can be used, for example, to provide a passenger compartment lighting function.

The system is arranged to produce an interior decoration light in the passenger compartment of the vehicle.

Another subject or object of the invention is a headlamp or an indicating lamp for a motor vehicle comprising an optical system as described previously.

Another subject or object of the invention is a vehicle equipped with a motor vehicle optical system according to any one of the preceding characteristics. Preferably, the vehicle includes a body exhibiting a form that is substantially continuous at the join between the outer face of the optical or lighting system and the body. That is to say, the outer surface of the optical system is in the outer extension of the body.

According to another object of the invention, a design method is provided for a motor vehicle optical system, in particular for an indicating and/or lighting device, comprising steps consisting in:

setting a prioritized optical direction in which the intensity of the light at the output of the optical system is maximal, laying down the form of an outer face of the system, this face not being contained in a plane that is substantially normal to the prioritized optical direction, arranging a surface light source exhibiting a front wall and emitting a light, the intensity of which is maximal in a principal direction of emission, providing an optical guide comprising an input face and an output face forming at least partly the outer face of the system, such that the light emitted by the surface source penetrates the guide through the input face and escapes from the guide through the output face, defining the configuration of the optical guide such that the intensity of the light at the output of the optical system is maximal in a direction that is substantially identical to the prioritized optical direction.

Other features, aims and advantages of the present invention will become clear from reading the following detailed description, and with reference to the accompanying drawings, given by way of non-limiting examples and in which:

BRIEF DESCRIPTION OF THE ACCOMPANYING DRAWINGS

DETAILED DESCRIPTION OF THE PREFERRED EMBODIMENTS

The optical system for a motor vehicle, in particular for an indicating and/or lighting device, according to the invention, is arranged to emit a light, the intensity of which is maximal in a given prioritized optical direction 20. This prioritized optical direction 20 is set when the system is being designed. In practice, this prioritized optical direction 20 is most often horizontal. When the system has a stop lamp function, a reversing lamp function or a front lighting function for the vehicle, this prioritized optical direction 20 corresponds generally to the road axis at the level of or in front of the vehicle, or to the direction of movement of the vehicle. The prioritized optical direction 20 can also be defined by a mapping system, or a steering or wheel rotation sensor, or a road bend sensor (white line sensor, etc.).

The system exhibits an outer face which is not contained in a plane that is substantially normal to the prioritized optical direction 20. This outer face can thus be inclined or otherwise with respect to the prioritized optical direction, flat or otherwise, etc. Several example outer faces will be described hereinafter with reference to the drawings.

Characteristically, the system includes a surface light source.

A surface light source is one for which the light-generating zone extends over a surface. This source is therefore not a point source and is differentiated in this sense from conventional light sources that involve the use of for example a bulb. Indeed, in a bulb, the light-generating zone is limited to the bulb filament. For example, this surface source can have a surface area greater than 1 $cm^2$, or even, greater than 10 $cm^2$.

In the context of the invention, the surface source can for example be an organic light-emitting diode, usually denoted by its acronym OLED. In a known manner, an OLED is a diode generally composed of a layer of semiconductor organic material, comprising for example atoms of carbon, hydrogen, oxygen and nitrogen, placed between a metal cathode and a transparent anode. This multilayer assembly rests on a substrate, usually made of glass or of plastic material. When an electric current is passed through it, the layer of semiconductor organic material emits light which is propagated outside the OLED through the anode and/or cathode.

There exist known techniques which consist, for example, in markedly increasing the directivity of emission in the direction that is perpendicular to the plate of the OLED 30. Typically, this has the effect of increasing the luminance by a factor of between 2 and 10. Thus, a luminance of the order of 10,000 $Cd/m^2$ is easily obtained.

Thus, the surface source used in the context of the invention is arranged such that the light emitted is maximal in a direction that is substantially normal to the front wall of the OLED.

Figure 6:
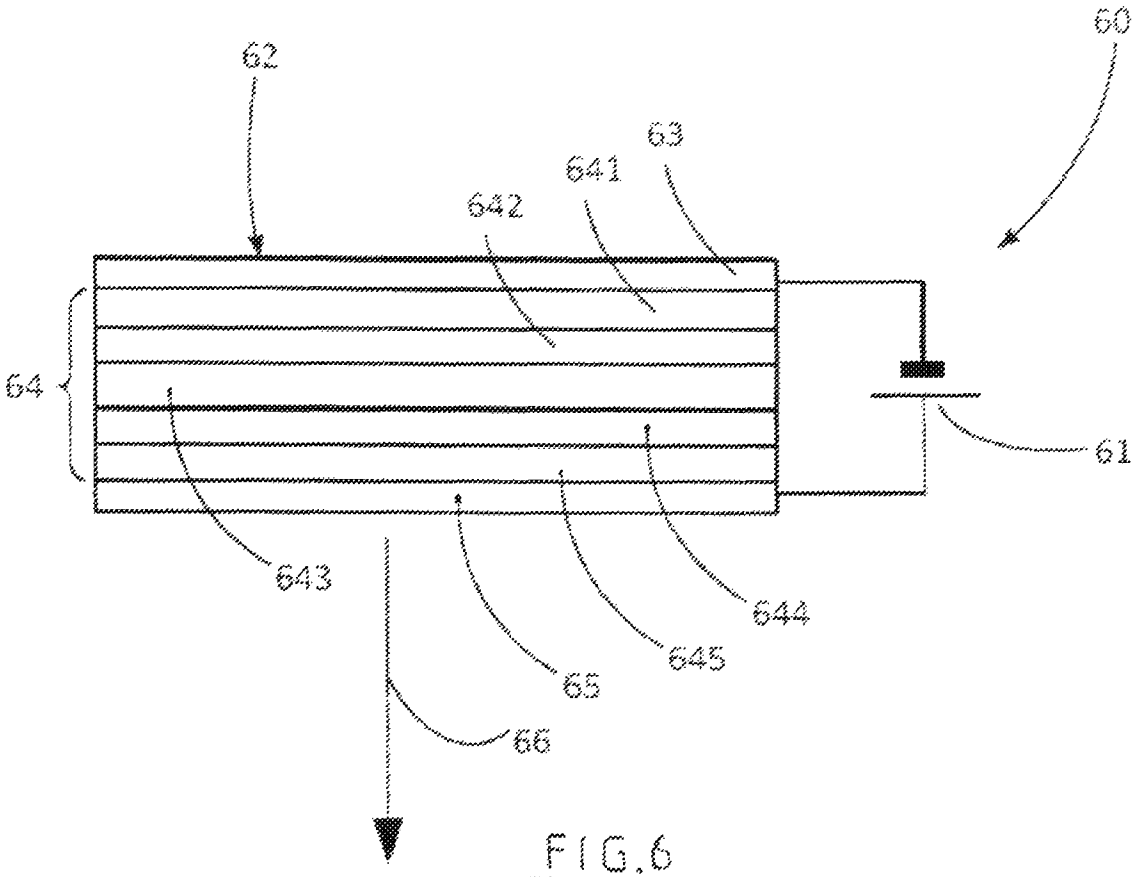
FIG. 6 illustrates an example organic light-emitting diode.

An example OLED is illustrated in FIG. 6. The organic light-emitting diode device 60 represented comprises an organic light-emitting diode 62 and an electrical voltage generator 61. The organic light-emitting diode 62 comprises several layers: a cathode 63, an anode 65 and an organic layer 64. When the organic layer 64 is subjected to an electrical voltage, it emits light radiation 66 propagating through the anode 65 which is transparent in respect of this light radiation 66. The organic layer 64 can if necessary comprise various strata 641 to 645 made of various organic materials. Preferably, organic light-emitting diodes 62 comprising additional strata are used. In addition to the light-emitting stratum 643, the organic layer 64 comprises a stratum 641 encouraging the transport of electrons up to the emitting stratum 643 and a stratum 645 encouraging the transport of holes, i.e. absences of electrons, up to the emitting stratum 643. The organic layer 64 can also comprise a stratum 642 blocking the holes from the lower strata, 643 to 645, and a stratum 644 blocking the electrons from the upper strata 641 to 643. All these strata form a microcavity, the thickness of which is adjusted to create an optical resonance. Thus, selective interferential reflectors are produced which form resonant cavities. For example, an organic light-emitting diode of the type described in document FR 2 926 677, which is equivalent to U.S. Patent Publication 2011/0079772, which documents are incorporated herein by reference and made a part hereof, mentioned earlier can be used.

The system also comprises an optical guide 1.

The term "optical guide" refers to a part inside of which light rays propagate from an input face up to an output face. Other faces, referred to as inner faces, can, through internal reflection, provide a propagation of rays inside the guide up to the output face. In particular, the color, form or intensity of the beams are not substantially modified. Hence the observer has the impression that the whole output face is lit and that this face corresponds to a light source.

In the sense of the present invention, a guide is not necessarily cylindrical. It generally denotes transparent materials which can have a large thickness, and this includes tubes, sheets or solid parts.

The optical guide 1 can be glass or made of polymethyl methacrylate (PMMA), for example.

The system is arranged such that the light emitted by the surface source penetrates the guide 1 through the input face 2 and escapes from the guide 1 through the output face 3.

The input face 2 of the guide 1 covers at least partly the front wall of the OLED 30. Preferably, the input face 2 is pressed against the front wall of the OLED 30. Preferably, the contours of the input face 2 of the guide 1 are to be as close as possible to those of the surface source.

The output face 3 is therefore not contained in a plane that is substantially normal to the prioritized optical direction 20. The orientation and form of this output face 3 can therefore be set when the vehicle is being designed, in order to meet for example style or size requirements. The examples that follow will reveal varied forms for the output face 3. In particular, provision can be made for the output face 3 to be rounded, bent, inclined etc., in order to follow the curvature of the vehicle body.

For example, generally in the present invention, the output face 3 can form at least partly the outer face of the optical system, thereby directly facing the outside of the vehicle. The output face 3 of the guide 1 can also follow at least partly the form of the cover lens of a casing of a motor vehicle headlamp and/or indicating lamp. Additionally, this system can be contained in the casing of a motor vehicle headlamp or indicating lamp, without being in contact with the cover lens of this casing; for arrangement and aesthetic reasons, this output face 3 can have a curvature set by the design process of this headlamp or this lamp, for example due to the form of the casing, the curvature of the cover lens, and/or a particularly desired form.

Preferably, the optical guide 1 is conformed such that the intensity of the light at the output of the system is maximal in a direction that is substantially identical to the prioritized optical direction 20.

The invention can thus be used to emit from a large surface area, perceived as being an illuminating surface, with a satisfactory luminance in the prioritized optical direction 20 while overcoming constraints related to the orientation or form of the outer face. The external aesthetics of the optical system according to the invention can thus be designed freely.

Furthermore, the invention exhibits the advantage of providing a very homogeneous distribution of the light over the entire output face 3 regardless of the direction of observation. Thus, an observer does not identify a discontinuity on the output face 3 which is perceived as being the surface of emission of the light.

Figure 1:
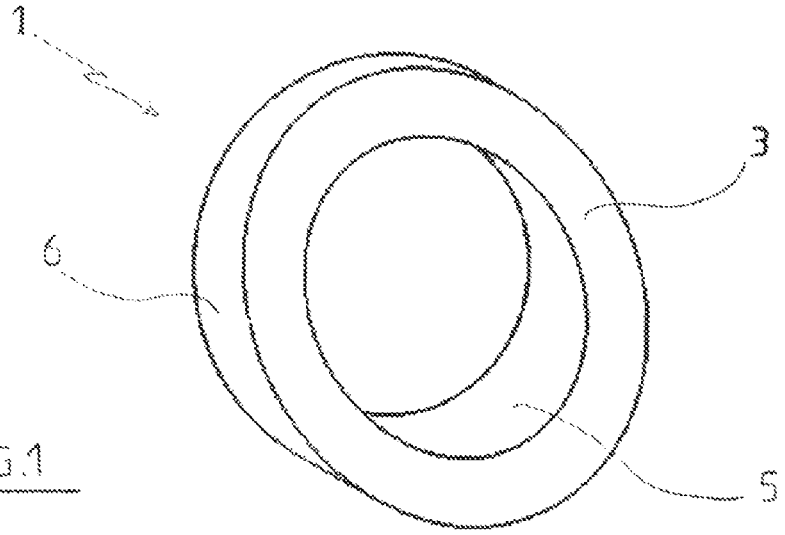
FIG. 1 is a perspective view of a first example system according to the invention.
Figure 2:
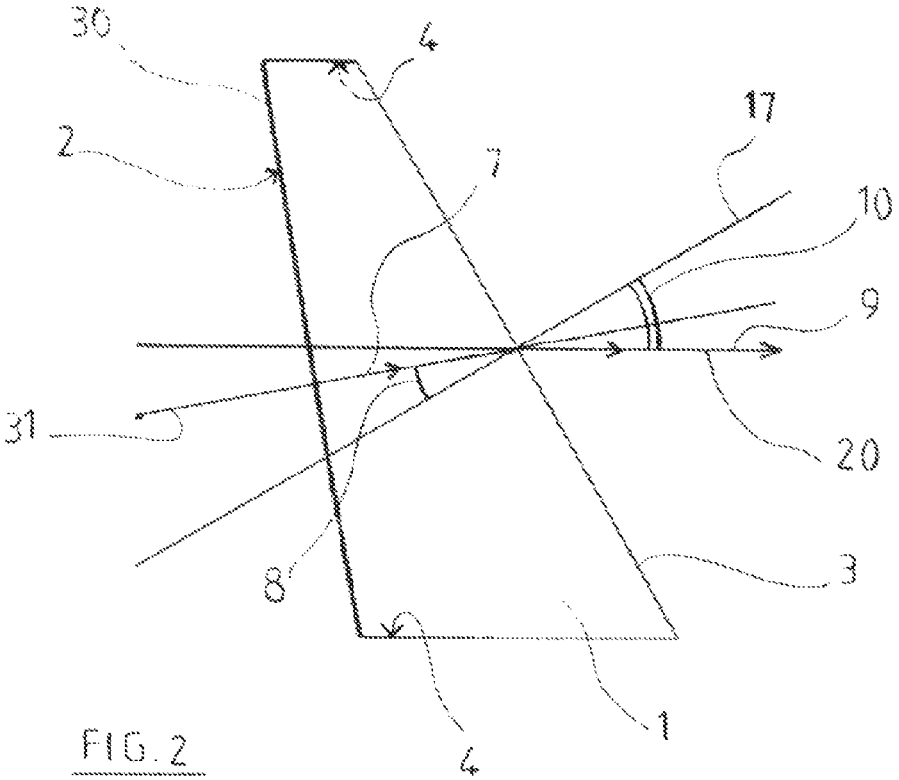
FIG. 2 is a cross section view of the first example illustrated in FIG. 1 and in which the propagation of optical rays for the beam is illustrated schematically.

A first example embodiment will now be described with reference to FIGS. 1 and 2.

In this example embodiment, the output face 3 of the guide 1 is inclined.

The guide 1 is arranged such that the light penetrating the input face 2 reaches, mainly directly, the output face 3. Reflections on the inner faces 4 of the guide 1 are of course not excluded. However most of the rays reach the output face 3 without reflection. The thinner the guide 1, the more the rays are reflected on the walls.

The OLED 30 is pressed against the input face 2 of the guide 1. It emits an increased luminance in a direction 31 that is substantially normal to the plane in which it extends. Typically, this plane corresponds to the plate of the OLED 30, i.e. the layer forming the substrate of the OLED 30.

The input face 2 is oriented with respect to the output face 3 such that the guide 1 deflects the light into the prioritized optical direction 20. More particularly, a light ray 7 emitted by the surface source penetrates the guide 1 through the input face 2 and reaches the output face 3 with an angle of incidence 8 with respect to the normal 17 at this output face 3. By refraction at the output face 3, the incident light ray 7 is refracted and propagates outward with an angle of refraction 10 with respect to the normal 17 which gives it a direction 9 that is substantially identical to the prioritized optical direction 20. A person skilled in the art, by virtue of their general knowledge in the field of optics, will without difficulty know how to calculate the orientation to give to the input face 2 as a function of the form and of the orientation of the output face 3, as well as the refractive index of the media within which the light propagates.

By orienting the input face 2, a maximal light intensity is therefore obtained in a direction corresponding substantially to the prioritized optical direction 20, typically the axis of the road.

In this particular example, the output face 3 forms a closed shape. This shape forms a ring. The guide thus comprises inner walls 5 and outer walls 6. Preferably, but in a non-limiting way, they are polished and do not comprise a coating, which is generally sufficient to provide total reflections inside the guide. Other closed-shape forms can clearly be envisaged, such as for example a polygonal shape, elliptical shape, etc. The invention also provides for producing non-closed shapes or any other geometric form.

The invention also provides a wide freedom of choice as regards the inclination of the output face 3. The output face 3 can also be rounded, bent or curved. The output face 3 can simultaneously be inclined and rounded, bent, curved, etc.

In this example, the output face 3 forms in its entirety the outer face of the system.

Figure 3:
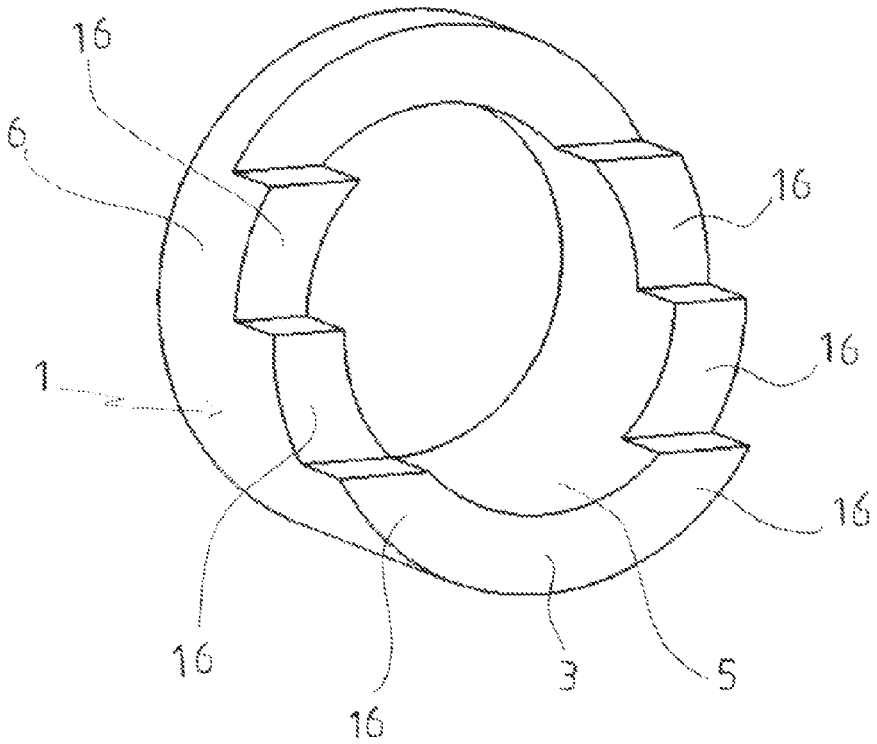
FIG. 3 is a perspective view of a second example system according to the invention.

With reference to FIG. 3, another embodiment will now be described. In this embodiment, the outer face 3 is not included in one plane and exhibits reliefs. These reliefs are for example staircase steps 16 which provide a visual effect of relief and depth.

The steps are distributed over a shape. This shape is for example closed and defines a ring.

The invention gives the impression that the light is directly emitted by the output face 3 of the guide 1, thereby providing an effect of original and aesthetic volume and depth.

Fabrication of the system is particularly simple since it is simply a matter of making the input face 2 of the guide 1 cooperate with the front wall of the OLED 30 and of orienting the input face 2 such that the intensity of the light is maximal in the prioritized optical direction 20.

Figure 4:
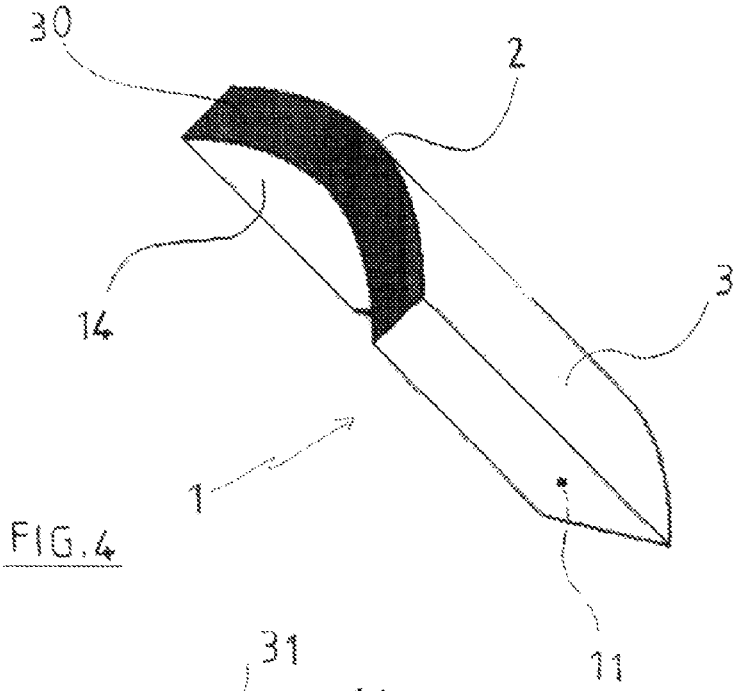
FIG. 4 is a perspective view of a third example system according to the invention.

Another embodiment will now be described with reference to FIGS. 4 and 5. In this embodiment, the guide 1 includes a reflecting face 11 oriented so as to receive the light that has penetrated the guide 1 through the input face 2 and oriented so as to direct this light toward the output face 3 by reflection.

Thus, the guide 1 is conformed in order that the light reaches the output face 3 by reflection and is transmitted by refraction through this output face 3 so as to exhibit a maximal intensity in the prioritized optical direction 20. In a particularly advantageous manner, a satisfactory luminance can thus be obtained in the prioritized optical direction 20 while overcoming orientation constraints at the output face 3 and input face 2.

The orientation and positioning requirements are thus transferred to the reflecting face 11. A person skilled in the art, using their general knowledge in the field of optics, will without difficulty arrive at orienting the reflecting face 11.

In this example, the output face 3 is adjacent to the input face 2 and the reflecting face 11 is opposite the input face 2.

Figure 5:
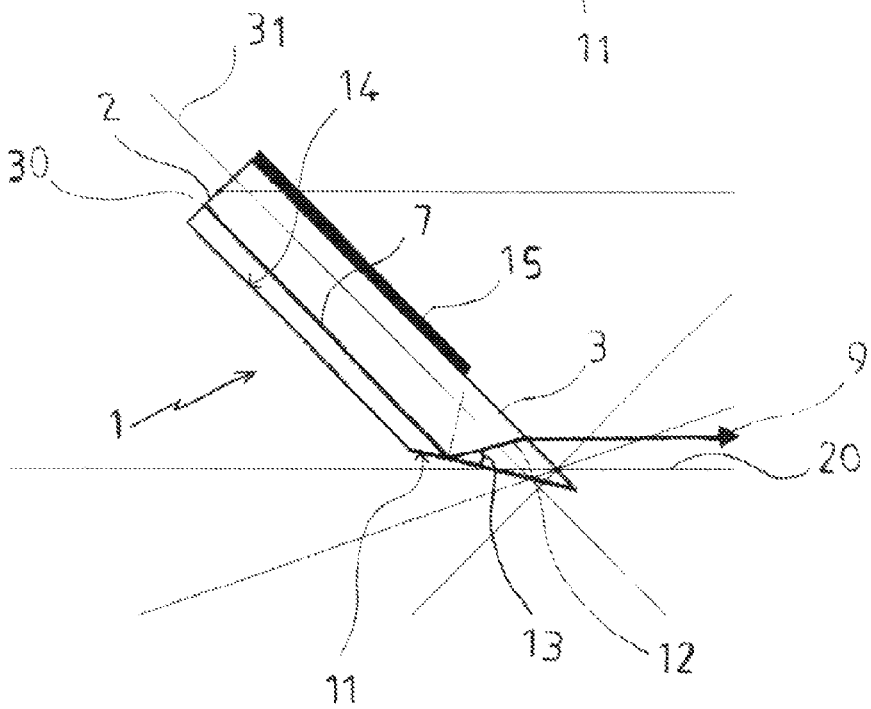
FIG. 5 is a cross section view of the third example illustrated in FIG. 4 and in which the propagation of optical rays for the beam is illustrated schematically.

FIG. 5 comprises a diagram showing the path of a light ray emitted by the surface source. The incident ray 7 is emitted by the OLED 30 in a direction 31 that is normal to the plane in which the OLED 30 extends. The ray 7 then propagates in the guide 1 and reaches, mainly directly, the reflecting face 11. The incident ray 7 at the reflecting face 11 is reflected toward the output face 3. By refraction, this reflected ray 12 is deflected at the interface formed by the output face 3 and escapes therefrom with a direction that is substantially identical to the prioritized optical direction 20.

In this non-limiting example, the output face 3 is curved. The guide 1 additionally exhibits a face 14 opposite the output face 3. This opposite face 14 is also curved. Since this opposite face 14 is not flat, it cannot receive the OLED 30. The OLED 30 is hence arranged on a flat surface which, in this example, is adjacent on the one hand to the output face 3 and on the other hand to the opposite face 14. The cross section of the guide in a plane that is normal to the plate of the OLED 30 exhibits the shape of a quadrilateral, two opposite sides of which are parallel and one of the other sides of which is perpendicular to the two parallel sides.

This example embodiment clearly illustrates the advantages provided by the invention in terms of aesthetic freedom. Specifically, the input face 2 and output face 3 can be freely oriented. Additionally, the output face 3 and the face 14 opposite it can exhibit totally arbitrary forms and in particular forms that are not contained in one plane.

Demanding requirements in terms of size and/or aesthetics can thus be met. This embodiment turns out to be particularly advantageous, for example, for producing center high mount stop lamps. These stop lamps are often placed against the rear tailgate window. It is often desirable to liberate the face turned toward the interior of the passenger compartment both from the OLED 30 and from the electrical connections of the latter. The invention provides for shifting the OLED 30 and its electrical connections onto a face that is not turned toward the interior of the passenger compartment.

Optionally, the invention can also comprise the following characteristics which can be combined with each of the embodiments described previously.

The outer face can comprise a mask 15 (FIG. 5) preventing the light from escaping and thus reducing the surface area of the output face 3. This can for example be used to stop parasitic rays which would escape from the guide 1 directly near the surface source. This provides for improving the clarity of the illuminating zone of the guide. Typically, a mask 15 can be formed by a reflecting coating covering a portion of the guide 1. In the embodiment illustrated in FIGS. 4 and 5, this mask 15 can for example cover the guide 1 from the input face 2, extend over the output face 3 and stop on the latter to leave only a bottom portion of it free. This bottom portion corresponds to the main zone on which the rays 12 reflected by the reflecting face 11 directly reach the output face 3.

In certain embodiments, when the system is fitted on a vehicle, the outer face is arranged in contact with the outside environment or it is covered by a protective layer, forming for example a portion of a cover lens of a casing, inside of which casing the system is housed.

Additionally or combined with the diffusing reliefs located at the surface of the output face 3, the guide 1 can also include diffusing reliefs located inside the guide 1 itself and conformed to form volumic patterns. These reliefs located inside and/or on the surface of the guide 1 provide a large number of stylistic possibilities, for thus improving and differentiating the aesthetics of the vehicle when the light source is activated.

The system according to the invention is particularly advantageously applied to a stop lamp or a turn indicator or a reversing lamp or a center high mount stop lamp (CHMSL). Several systems according to invention can be brought together in the same indicating and/or lighting module, each of the systems providing a different indicating and/or lighting function. Indeed, a module can incorporate at least two of the following functions: reversing lamp, stop lamp, turn indicator, lighting, etc.

The system according to the invention is used for example to provide a good continuity of form at the join between the surface perceived as being the emitting surface and the body. It can thus be integrated perfectly into a highly curved body.

The invention also relates to a method for designing a display system for a motor vehicle. This method comprises the following steps:

- A prioritized optical direction 20 is set, in which the intensity of the light is maximal.
- The form of the output face 3 of the system is set. This form can be set by the aesthetics to be imparted to the vehicle, for example to follow the curvature of the body. The output face 3 is intended to remain visible from the outside during operation. The output face 3 is not contained in a plane that is substantially normal to the prioritized optical direction 20.
- The front wall of the surface source 30 is covered with the input face 2 of the optical guide 1.
- The guide 1 is configured by orienting the input face 2 and/or the possible reflecting face 11, such that the intensity of the light at the output of the system is maximal in a direction that is substantially identical to the prioritized optical direction 20.

The present invention is not limited to the embodiments described above, but extends to any embodiment that conforms with its spirit.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. An optical system for a motor vehicle, in particular for an indicating and/or lighting device, arranged to emit a light, the intensity of which is maximal in a given prioritized optical direction, said optical system comprising:

a surface light source exhibiting a front wall emitting a light, the intensity of which is maximal in a principal direction of emission, said surface light source not being a point light source and comprising an organic light-emitting diode having an anode, a cathode and an organic layer adapted to emit said light when said organic layer is subject to an electrical substantially normal to a plane in which said front wall lies;

an optical guide comprising an input face and an output face forming at least partly an outer face of said optical system, said optical system being arranged such that the light emitted by said surface light source penetrates said optical guide through said input face and escapes from said optical guide through said output face, said input face of said optical guide being adjacent to and at least partly covering said front wall of said organic light-emitting diode, said output face of said optical guide is not contained in a plane that is substantially normal to said prioritized optical direction; and wherein said principal direction of emission is different from said prioritized direction;

said optical guide being conformed such that the intensity of the light at the output of said optical system is maximal in a direction that is substantially identical to said prioritized optical direction.

2. The optical system as claimed in claim 1, in which said input face is oriented with respect to said output face in order that the light penetrating said input face reaches, mainly directly, said output face.

3. The optical system as claimed in claim 1, including at least one reflecting face and arranged in order that said at least one reflecting face reflects onto said output face the light coming from said input face.

4. The optical system as claimed in claim 1, wherein an area of emission of said surface light source is greater than 1 $cm^2$.

5. The optical system as claimed in claim 1, wherein said surface light source exhibits a high directivity of emission in a direction perpendicular to its emitting surface, as compared with Lambertian light-emitting diodes.

6. The optical system as claimed in claim 1, wherein said surface light source has a luminance of at least 5,000 $Cd/m^2$.

7. The optical system as claimed in claim 1, in which a portion of said outer face includes an optical mask partly covering said optical guide such that said portion of an unmasked outer face defines said output face.

8. The optical system as claimed in claim 1, in which said output face is curved or rounded.

9. The optical system as claimed in claim 1, in which said output face forms a shape, preferably a ring or the periphery of a polygon.

10. The optical system as claimed in claim 1, including diffusing reliefs located inside said optical guide and conformed to form volumic patterns.

11. The optical system as claimed in claim 1, forming a stop lamp or a center high mount stop lamp or a turn indicator or a reversing lamp.

12. A headlamp or an indicating lamp for a motor vehicle, comprising an optical system as claimed in claim 1.

13. A vehicle equipped with a motor vehicle optical system as claimed in claim 1, including a body exhibiting a form that is substantially continuous at a join between said outer face of said optical system and said body.

14. The optical system as claimed in claim 2, in which said input face is oriented with respect to said output face in order that the light penetrating said input face reaches, mainly directly, said output face.

15. The optical system as claimed in claim 2, including at least one reflecting face and arranged in order that said at least one reflecting face reflects onto said output face the light coming from said input face.

16. The optical system as claimed in claim 2, in which said principal direction of emission is different from prioritized optical direction.

17. The optical system as claimed in claim 2, wherein an area of emission of said surface light source is greater than 1 $cm^2$.

18. The optical system as claimed in claim 2, wherein said surface light source has a luminance of at least 5,000 $Cd/m^2$.

19. The optical system as claimed in claim 2, in which a portion of said outer face includes an optical mask partly covering said optical guide such that said portion of an unmasked outer face defines said output face.

20. The optical system as claimed in claim 2, in which said output face is curved or rounded.

21. The optical system as claimed in claim 2, in which said output face forms a shape, preferably a ring or the periphery of a polygon.

* * * * *

UNITED STATES PATENT AND TRADEMARK OFFICE

CERTIFICATE OF CORRECTION

PATENT NO. : 8,998,467 B2
APPLICATION NO. : 13/575114
DATED : April 7, 2015
INVENTOR(S) : Dubosc et al.

It is certified that error appears in the above-identified patent and that said Letters Patent is hereby corrected as shown below:

In the Claims

Claim 1, Column 10, line 45, after "electrical," insert -- voltage, said organic light emitting diode having a front wall and emitting light in a direction --

Signed and Sealed this
First Day of December, 2015

Michelle K. Lee

Michelle K. Lee
*Director of the United States Patent and Trademark Office*